US007080694B2

(12) United States Patent
Boyle

(10) Patent No.: US 7,080,694 B2
(45) Date of Patent: Jul. 25, 2006

(54) METHOD AND SYSTEM FOR TESTING FOAM-WATER FIRE PROTECTION SYSTEMS

(76) Inventor: Thomas Joseph Boyle, P.O. Box 20, Galloway, OH (US) 43119

( * ) Notice: Subject to any disclaimer, the term of this patent is extended or adjusted under 35 U.S.C. 154(b) by 612 days.

(21) Appl. No.: 09/989,783

(22) Filed: Nov. 20, 2001

(65) Prior Publication Data

US 2003/0094286 A1 May 22, 2003

Related U.S. Application Data

(60) Provisional application No. 60/348,109, filed on Nov. 9, 2001.

(51) Int. Cl.
*A62C 35/00* (2006.01)
*A62C 2/00* (2006.01)
*A62C 25/00* (2006.01)

(52) U.S. Cl. ..... 169/14; 169/44; 169/45; 169/46; 169/52; 169/67; 169/24

(58) Field of Classification Search ..... 169/14, 169/44, 78, 45, 46, 52, 53, 24, 67, 13, 16; 73/61.62, 61.71, 49.5, 117.2; 239/71, 74, 239/67, 8, 93, 569, 413, 398
See application file for complete search history.

(56) References Cited

U.S. PATENT DOCUMENTS 4,599,890 A 7/1986 Girone et al.
4,729,403 A 3/1988 Roche
5,297,736 A 3/1994 Vickery
5,320,138 A 6/1994 Ferlitch, Jr.
5,803,596 A * 9/1998 Stephens ..... 366/10
5,881,818 A 3/1999 Lee et al.
5,944,051 A 8/1999 Johnson
6,010,083 A * 1/2000 Roe et al. ..... 239/427.5
6,085,586 A * 7/2000 Arvidson et al. ..... 73/201

* cited by examiner

*Primary Examiner*—Davis Hwu
(74) *Attorney, Agent, or Firm*—Calfee, Halter & Griswold LLP

(57) ABSTRACT

A test system (10) for testing a fire suppression system (100) for a determination of a flow ratio of at least two different constituents (2, 4) where the fire suppression system (100) is of a type that mixes the flow of the at least two constituents (2, 4) for distribution whereby only one of the two constituents (2, 4), is required for testing of the flow ratio, the system (10) comprising a control box (14), a first constituent flow meter system (16) and a second constituent line flow meter system (18), wherein the first constituent (2) is directed through the first constituent flow meter system (16), the first constituent (2) is directed through the second constituent line flow meter system (18), each flow meter system (16, 18) detecting a flow rate therein, and the control box (14) compares the flow rates of the first constituent (2) through each flow meter system (16, 18), and indicates the flow rate ratio had the second constituent (4) been directed through the second constituent line flow meter system (18). The system (10) is portable and waterproof, and obviates the need to discharge expensive foam concentrate (8) as well as disposal costs of foam.

25 Claims, 4 Drawing Sheets

METHOD AND SYSTEM FOR TESTING FOAM-WATER FIRE PROTECTION SYSTEMS

This application claims priority to provisional U.S. application Ser. No. 60/348,109 to be assigned, METHOD AND SYSTEM FOR TESTING FOAM-WATER FIRE PROTECTION SYSTEMS, inventor Tom Boyle, filed Nov. 9, 2001.

FIELD OF THE INVENTION

The invention relates to a fire suppression system, more particularly to foam-water fire protection systems, and most particularly to a method and system for testing foam-water fire protection systems.

BACKGROUND OF THE INVENTION

Many types of suppression systems currently exist. Of these, a great portion of these systems are dedicated to extinguishing fires or blanketing a spill where the material is of a type that water alone will not suffice. Often, these systems utilize a foam, typically a foam concentrate mixed with water via a proportioning valve such that the water mixes with and carries the foam through the system.

As with all fire suppression systems, it is the hope that the system is infrequently, if ever, needed to suppress a fire or prevent a hazardous spill from igniting. However, because of a lack of use, it is often uncertain whether fire suppression systems are in proper working order. In addition, a lack of use may lead those in control of the systems to neglect proper maintenance and testing.

One issue present with testing of a fire suppression system is the labor and cost involved. With foam-water suppression systems, typical testing methods involve sending foam through the proportioner and/or other parts of the system, and measuring the flow (volume and rate) of the mixture. The foam is specially formulated, must be purchased at an expense, and cannot be recycled. In addition, the use of the foam in testing results in an expensive disposal issue of the foam and water mixture due to environmental regulations. Furthermore, typical testing systems are cumbersome and laborious, as is the process itself. These factors further contribute to an inclination by some to delay proper testing and maintenance, or forego such altogether.

There is a variety of foam-water fire suppression systems. Two types are commonly referred to as an In-Line Balanced Pressure Proportioner system, or ILBP, and a Bladder Tank Proportioner system. Both of these rely on a source of foam concentrate and a source of water (fire protection water supply). Often times, the foam concentrate is stored in, for instance, a bladder tank. In both of these types of systems, as well as others, a valve known as a proportioner controls the mixing of the foam concentrate and water. Once the mixture passes through the proportioner, it is then forced through a portion of the fire suppression system containing sprinklers or other devices for applying the foam/water mixture to the area of concern, either a fire or a hazard with potential for fire. In these systems, it is of great concern that the levels are properly mixed, a fact that relies to some degree on pressure on the valve and in the lines providing the water and foam concentrate. This requires being able to test the effectiveness and proper working order of the proportioner and of the system in general.

As an international standards organization, the National Fire Protection Association (NFPA), of Quincy, Mass., has developed standards for the testing of various fire equipment. Among these standards is Standard 25, Standard for Inspection testing, and Maintenance of Water-Based Fire Protection Systems. The neglect of maintenance and testing of fire protection and suppression systems is a serious issue, and it has long been desired to be able to test the systems easily and without a great expense.

BRIEF SUMMARY OF THE INVENTION

In accordance with one aspect of the present invention, a test system 10 for testing a fire suppression system 100 for a determination of a flow ratio of at least two different constituents 2, 4 where the fire suppression system 100 is of a type that mixes the flow of the at least two constituents 2, 4 for distribution whereby only one of the two constituents 2, 4, is required for testing. The test system 10 comprises a control box 14, a first constituent flow meter system 16, and a second constituent line flow meter system 18, wherein the first constituent 2 is directed through the first constituent flow meter system 16, the first constituent 2 is directed through the second constituent line flow meter system 18, each flow meter system 16, 18 detecting a flow rate therein, and the control box 14 compares the flow rates of the first constituent 2 through each flow meter system 16, 18, and indicates the flow rate ratio had the second constituent 4 been directed through the second constituent flow meter system 18.

The test system 10 is preferably portable, and may be connected and disconnected to the fire suppression system 100. The control box 14 is preferably waterproof and includes a pair of flow rate meters 30, 32. The test system 10 of can include a recording means 12, preferably a flatbed recorder. The first constituent flow meter system 16 receives the first constituent 2 from a fire protection first constituent supply source 15 at a flow rate appropriate for actual fire suppression conditions, and the second constituent line flow meter system 18 receives the first constituent 2 from a water balance line 122. The test system 10 can include a booster pump 312 between the second constituent line flow meter system 18 and the water balance line 122 thereby providing the first constituent 2 with an inlet pressure to the second constituent line flow meter system 18 appropriate for actual fire suppression conditions to an outlet pressure from the second constituent storage 102. The test system 10 is designed so that the first constituent 2 may be discharged from the test system 10, or may be recovered. A nozzle 230 can be provided on the discharge for providing a sufficient pressure to the test system 10. In a preferred embodiment, the first constituent 2 is water and the second constituent 4 is foam concentrate.

In a second preferred embodiment, a test system 10 is provided as above, with the additional ability of measuring the actual flow rate of the mixed constituents 2, 4 by directing the mixed flow through the test system 10, and a probe 58 is located in the path of the mixed flow. The probe 58 can be connected to a conductivity controller 34 located in the control box 14, the control box 14 displaying a reading of the flow by correlating the conductivity of the mixed flow to a conductivity of the two constituents 2, 4 based on the proportions of the two constituents 2, 4 present in the flow. This second embodiment may be utilized to determine the actual proportions of the two constituents 2, 4 in the mixed flow where both constituents 2, 4 are sent through the fire suppression system 100, or may be utilized as a verification tool and calibratio means for the test system 10.

BRIEF DESCRIPTION OF THE DRAWINGS

In the drawings.

Corresponding reference numerals will be used throughout the several figures of the drawings.

DETAILED DESCRIPTION OF THE INVENTION

Figure 1:
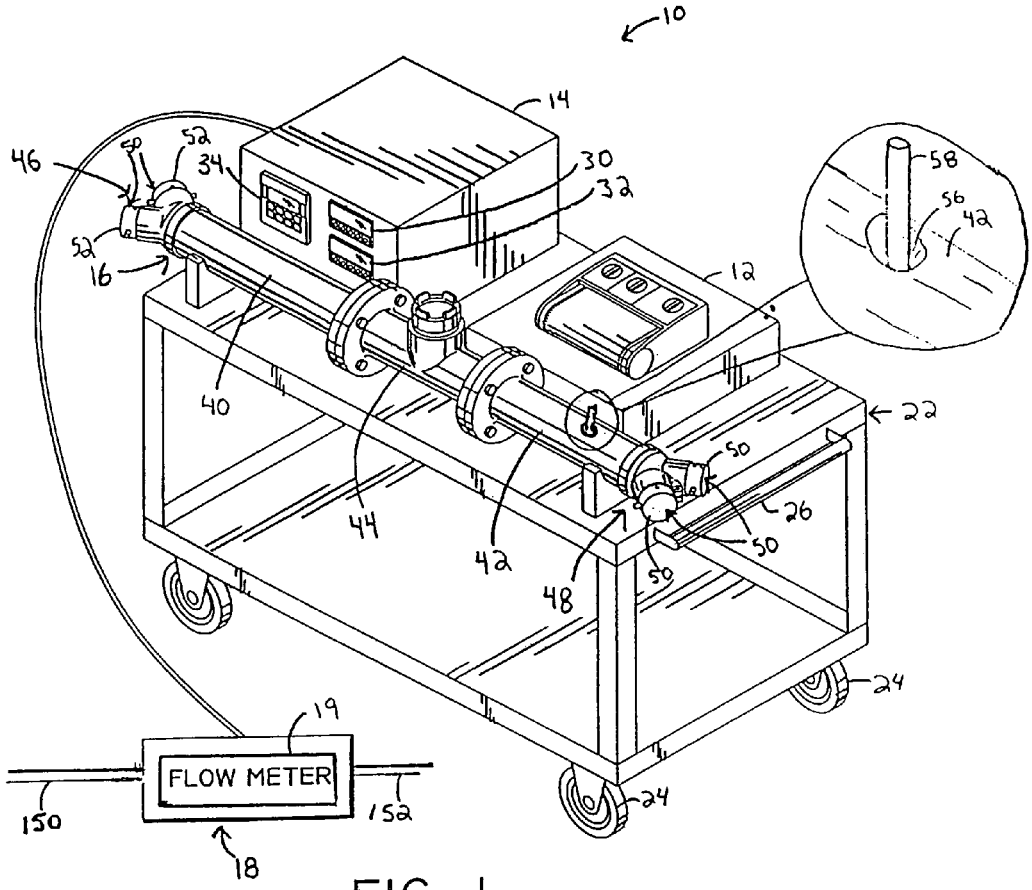
FIG. 1 is a perspective view of a preferred embodiment test system of the present invention.

Referring initially to FIG. 1, a test system 10 of the present invention is depicted including a chart recorder 12, an electronics control box 14, a water flow meter system 16, and a concentrate line flow meter system 18. The test system 10 is relatively small and compact. Accordingly, it can be mounted and transported for simple use and on-site deployment, as is pictured here on a test stand 22. In a preferred embodiment, the test stand 22 is a 4-foot by 6-foot cart with wheels 24 and a handle 26. The test system 10 measures the flow rates of two constituents 2 and 4 (see FIG. 2), principally water and foam concentrate, though others may be substituted as per the requirements of a fire suppression system 100 (see FIG. 2).

The recording means 12, such as a chart recorder, is used to record the measurements taken by the test system 10. In the present embodiment, a compact flatbed recorder is employed such as the RD 6100 2 pen chart recorder manufactured by Omega Engineering, Inc., of Stamford, Conn. It should be noted that the purpose of recording the test results may be either to make calculations based upon the results, or to establish proof of the testing. It should also be noted that other recording means may be employed, including other types of hard-copy (paper) recorders, or another means for recording data, such as magnetic tape or digital (computer/microprocessor) based recorders.

The electronics control box 14 includes, in a preferred embodiment, a weather-proof enclosure since many of the uses of the system 10 are tests performed outside of any protective enclosure, as well as the fact that the system 10 is measuring the flow of large amounts of water under pressure, water which could damage electronic components located within the control box 14. The control box 14 measures 20"×20"×10," thereby providing space for electronics contained therein. Preferably, the electronics control box 14 includes a power source rated at least about 110 VAC.

The electronics control box 14 contains a first flow rate meter 30, and a second flow rate meter, herein referred to as the concentrate meter 32. In the present embodiment both flow rate meters 30 and 32 are manufactured by Omega Engineering, Inc. and are sold as the DPF701 Series Rate Meter/Totalizer. The control box 14 also includes a conductivity controller 34. In a preferred embodiment, the conductivity monitor/controller 34 is manufactured by Omega Engineering, Inc. and sold as the CDCN-90A and is microprocessor based.

The first flow meter system 16 includes two sections of pipe 40, 42 with a water supply meter 44 mounted therebetween. In a preferred embodiment, each pipe 40, 42 is a 4" Schedule #40 BLK pipe, and the supply meter 44 is a turbine meter manufactured by the Omega Engineering, Inc. and marketed as a FTB-740, though other pipes and meters would also suffice. The preferred turbine meter has a flow meter range of 6–1100 gallons per minute (GPM). The first constituent flow meter system 16 has an inlet end 46 and outlet end 48. Each end of the flow meter system 16 includes hose connections 50. Preferably, the hose connections 50 are 2½" hose connections with National Standard Hose Threads (NSHT). As depicted, each hose connection 50 is covered with a standard hose cap 52. Along the length of pipe 42 is an outlet 56 into which is inserted (in the internal flow path of the pipe 42) a probe 58 of the conductivity monitor/controller 34. In the present embodiment, the Omega Engineering, Inc. manufactured CDCN-90A is used for the conductivity monitor/controller 34, as mentioned above.

The concentrate flow meter system 18 is connected to the control box 14. The concentrate flow meter system 18 is preferably a 2" stainless steel flow meter 19 rated at 250 p.s.i., such as that manufactured by Omega Engineering, Inc. and marketed as FTB720 with a flow rate range of 2–300 GPM. The flow meter 19 is then connected to the electronics control box 14.

Figure 2:
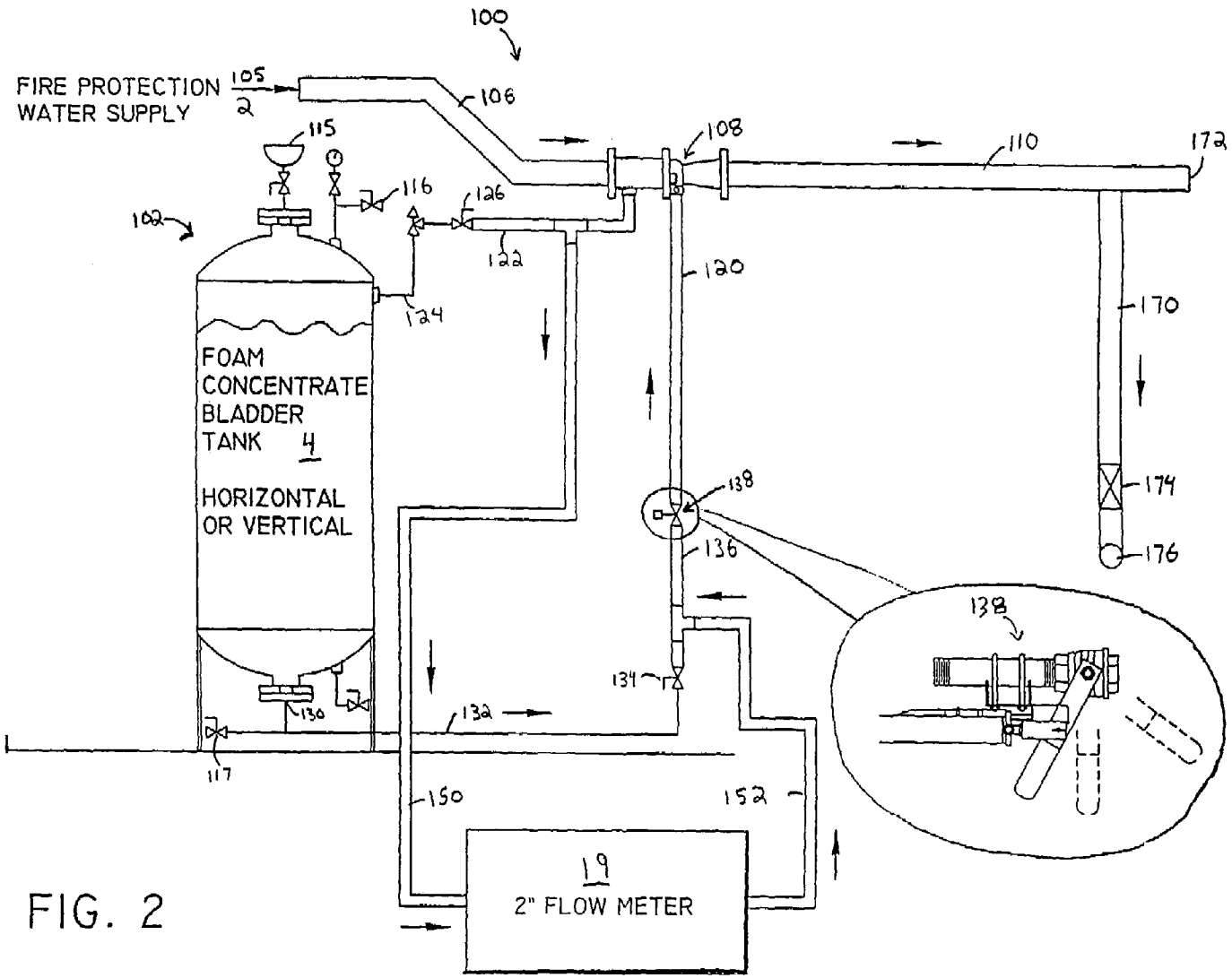
FIG. 2 is a representational view of a fire suppression system with a flow meter of the test system of the present invention attached thereto.

Referring now to FIG. 2, a typical fire suppression system 100 of the type utilizing a foam concentrate bladder tank system 102, also referred to as a bladder tank foam water system, is depicted. The bladder tank system 102 stores second constituent 4, typically foam concentrate, for the event the second constituent 4 is needed by the fire suppression system 100. FIG. 2 includes arrows indicating the direction of flow through various pipelines. The fire suppression system 100 depends on a fire protection first constituent supply 105 feeding into a supply pipe 106. The supply pipe 106 connects to a proportioner 108. The proportioner 108 is a valve as well as a mixer, in the sense that the proportioner 108 mixes supply of first constituent 2 with supply of second constituent 4 (foam concentrate) at the proper ratio. The proportioner 108 is also connected to a hazard pipe 110. The hazard pipe 110 feeds sprinkler system (see FIG. 6) or other means for dispersing the first and second constituent mixture (water/foam concentrate) by the fire suppression system 100. Feeding directly into the proportioner 108 is a foam concentrate outlet line 120. The foam concentrate outlet line 120 conveys foam concentrate directly from the bladder tank system 102 to the proportioner 108 for mixing. The bladder tank system 102 can include features known in the art, such as a fill connection 115, a pressure vacuum vent 116, and a tank drain valve 117.

As depicted, the fire suppression system 100 requires balanced pressure between the first and second constituents 2, 4 (water and foam concentrate). The fire suppression system 100 includes a water balance line 122 and a foam concentrate balance line 124 represented with a valve 126 between the balance lines 122, 124. Preferably, the valve 126 is a diapharam control valve providing automatic pressure balance.

Under fire suppression conditions, foam concentrate (second constituent 4) would be permitted to exit the bladder tank system 102 at an exit valve 130 along a concentrate feeder line 132. The concentrate feeder line 132 is connected to a valve 134, which is in turn connected to an intermediate feeder line 136. The intermediate feeder line 136 connects to a concentrate pressure regulating valve 138, which is in turn connected to the foam concentrate outlet line 120. The concentrate pressure regulating valve 138 is preferably a 2" water power ball valve. When the system 10 is in use, the concentrate pressure regulating valve 138 is actuated by the return flow exiting the concentrate flow meter system 18.

The flow meter 19 of the concentrate flow meter system 18 of the test system 10 connects to an inlet line 150 and an outlet line 152. The inlet line 150 connects to the water balance line 122, and the outlet line 152 connects to the intermediate feeder line 136. As such, water from the balance line 122 flows through the concentrate flow meter system 18, through the proportioner 108, and into the hazard pipe 110. In this use of testing, valve 134 is closed.

During testing as described, the water flowing through the hazard pipe 110 flows to a test outlet pipe 170. It should be noted that, under non-testing conditions, the flow through the hazard pipe 110 would be a mixture of foam concentrate and water, and the flow would not pass through the test outlet pipe 170, instead being directed to the sprinklers or other foam dispersing means through the hazard pipe 110 as at location 172. The test outlet pipe 170 has at its terminus a solution control valve 174 which connects to test stand line 176. The test stand line 176 connects to, for instance, a hose 178 (see FIG. 6) which connects to the hose connection 50 of the inlet end 46 of the water flow meter system 16 (see FIG. 1).

Figure 3:
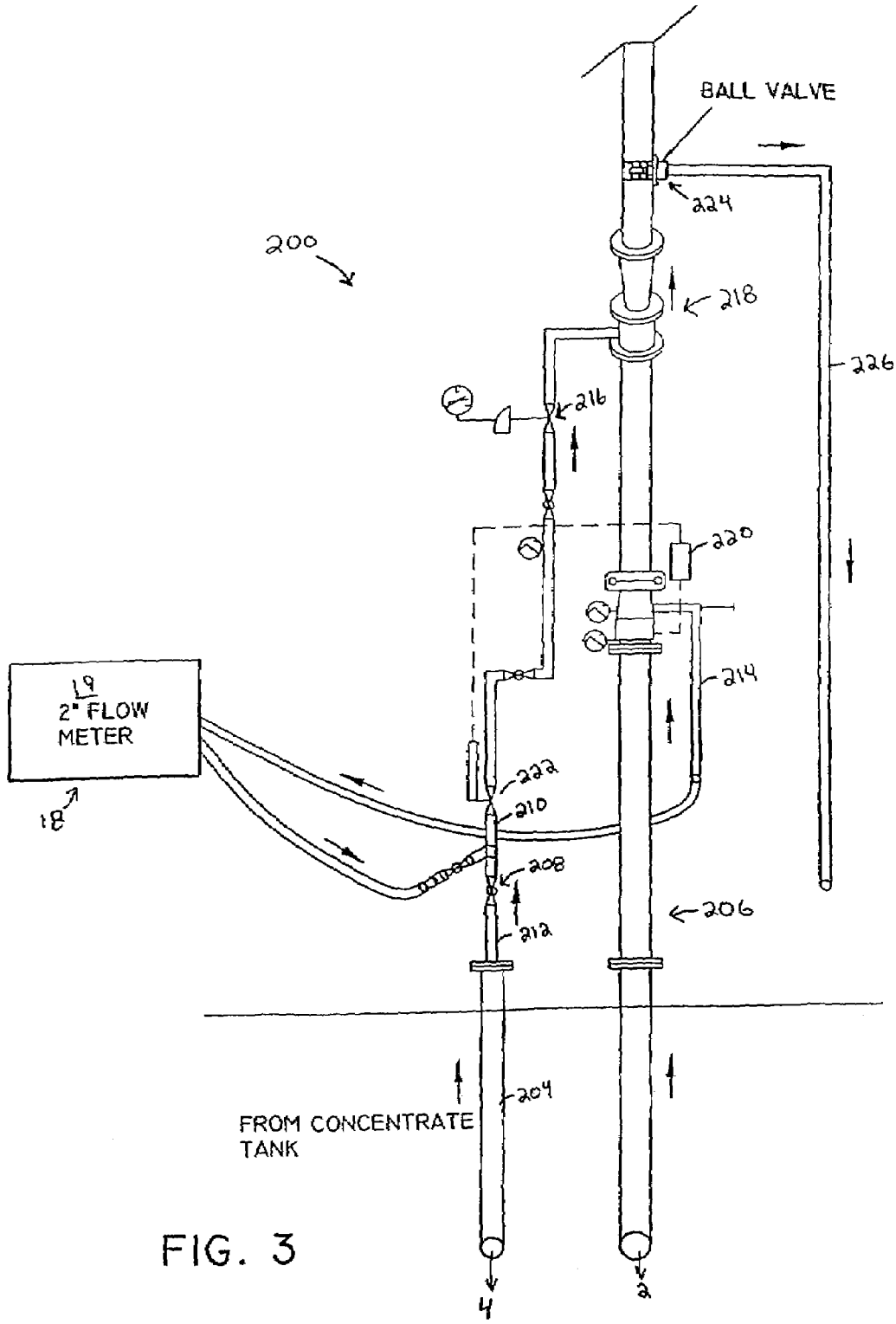
FIG. 3 is representational view of a flow meter of the test system of the present invention attached to a concentrate line and a water inlet pipe.

Referring now to FIG. 3, an exemplary use of the system 10 is depicted having the concentrate line flow meter system 18 and flow meter 19 connected to a fire suppression system 200. Foam concentrate (second constituent 4) is stored in a concentrate tank (FIG. 2) and is delivered via a foam inlet pipe 204. Water (first constituent) is delivered from a water supply (FIG. 2) and delivered via a water inlet pipe 206. A concentrate isolation valve 208 connects to the foam inlet pipe 204 located on the foam inlet pipe 204, the concentrate isolation valve 208 having an open/close locking capability. When testing, the concentrate isolation valve 208 is locked in closed position. A tee 210 is connected to the concentrate isolation valve 208, to the flow meter 19, and to a concentrate line 212. The flow meter 19 is additionally connected to a drain supply 214 from the water inlet pipe 206. When testing, water flows through the flow meter 19 into the tee 210 and into the concentrate line 212 instead of the foam concentrate. A balancing valve 216 is located on the concentrate line 212 for insuring that proper pressure flow through the concentrate line 212 is maintained. After the flow through the flow meter 19 and concentrate line 212 passes through the balancing valve 216, it enters a proportioner 218. As depicted, a retard chamber 220 actuates a water powered ball valve 222. When the fire suppression system 100 is tested or activated, water flows through the water inlet pipe 206, and the ball valve 222 is actuated by the retard chamber 220 to open the concentrate line 212 so that the foam concentrate (during fire suppression conditions) or water (during testing conditions) passes through to the proportioner 218.

After the proportioner 218, the combined flow from the concentrate line 212 and the direct flow from the water inlet pipe 206 flow through a ball valve 224 and into a test outlet pipe 226 to the hose connection 50 (see FIG. 1).

Figure 4:
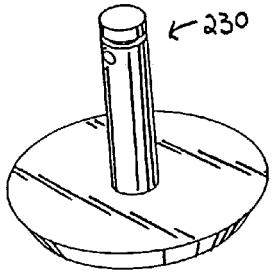
FIG. 4 is a perspective view of a hose nozzle of the present invention.
Figure 5:
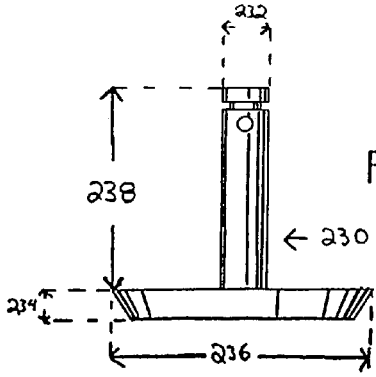
FIG. 5 is side elevation view of the hose nozzle of the present invention.

Referring now to FIGS. 4 and 5, a hose monster 230 is depicted. The hose monster 230 is a nozzle manufactured by Hydro Flow Products, Inc. of Rolling Meadows, Ill. In order to properly connect to an outlet hose 320 (see FIG. 6), the selected hose monster 230 preferably has an inlet diameter 232 of 4 inches. Furthermore, the hose monster 230 has an outlet diameter 234 of 6", a outlet length 236 of 23", and inlet length 238 of 15", and an overall weight of 27 pounds. The hose monster 230 is necessary to provide the proper pressure on the flow of water.

Figure 6:
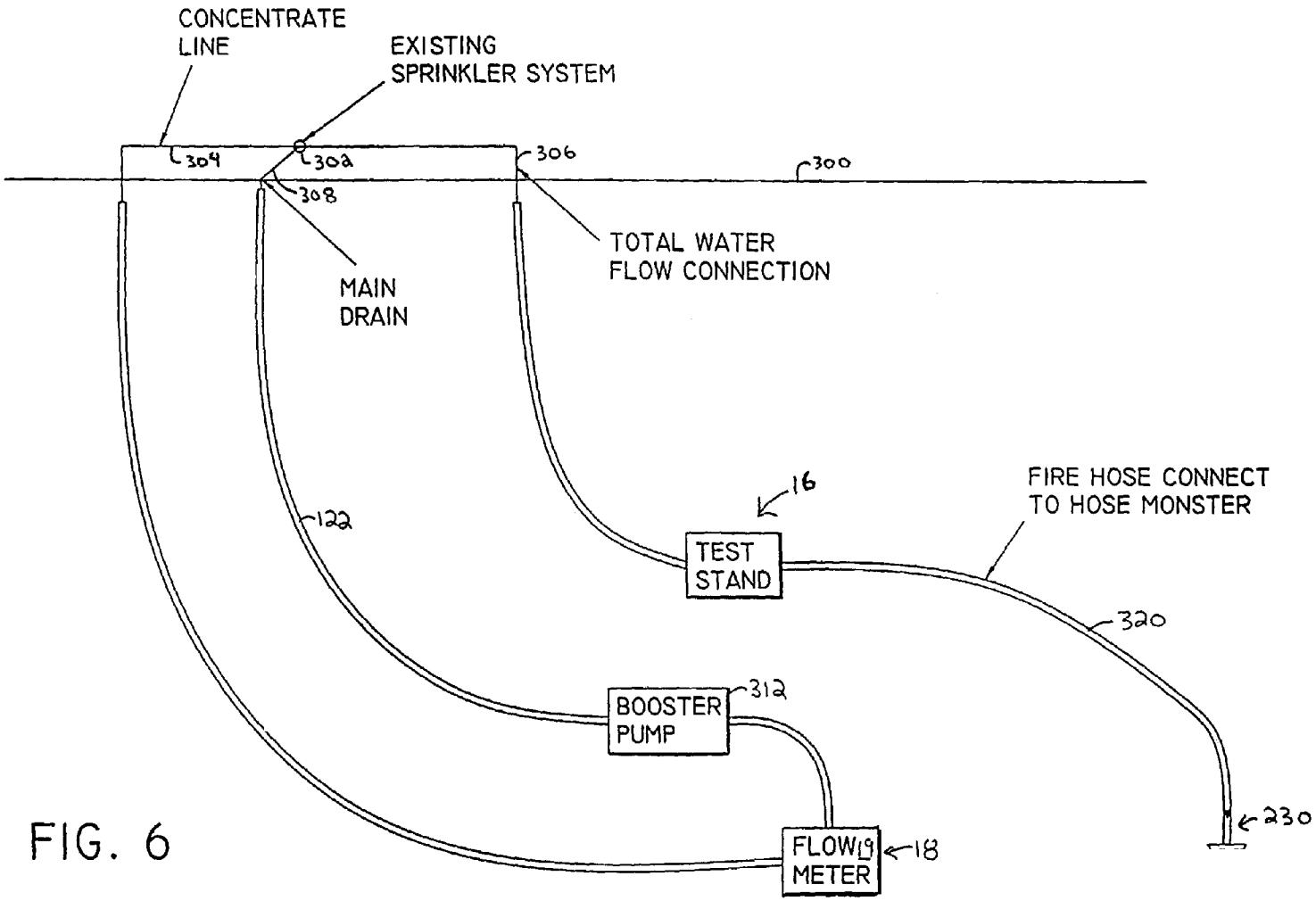

FIG. 6 is a diagram of one embodiment and use of the present invention. As depicted, there is an existing structure 300 above which is located an existing sprinkler system 302. Connecting to the sprinkler system 302 is a concentrate line 304 for delivering foam concentrate to the system, as well as a water flow connection 306 for delivering water. The concentrate line 304 and a main drain 308 of the sprinkler system 302 connect to the concentrate flow meter system 18 (flow meter 19). Flow of water passes from the main drain 308, through a booster pump 312 and flow meter 19, and returns to the concentrate line 304 where it passes through a proportioner (FIGS. 2, 3). The proportioner combines this flow with the main flow of water from the water supply. It should be noted that in bladder tank systems, the booster pump 312 is unnecessary because the existing water pressure supplied for the system 10 is the same pressure as would be exerted on the bladder tank. Thus, the amount of foam that would be displaced by the pressure is the same as the pressure of the water being injected in place of the foam concentrate. Combined flow from the proportioner passes through the test system 10 at the test stand 22 (FIG. 1) and into an outlet hose 320 and is discharged from the hose monster 230.

It is known that each fire suppression system of the types to which this system 10 is applicable require a proportional flow of water to foam concentrate. Each fire suppression system is provided with specific relative flow rates. Often, these fire suppression systems are specifically designed and built for a particular location, similar to the way that of air conditioning and heating systems (HVAC) systems are. The rates of flow for water and foam concentrate are dictated by the test and the characteristics of the foam itself. The flow rate for water is measured by the test system 10 by outletting the actual water of the system through the test stand line 176 (see FIG. 2) connected to the hose connection 50 of the inlet end 46 of the water flow meter system 16 (see FIG. 1). The flow rate of the foam concentrate is measured as the water supply system provides pressure (which may be boosted by the booster pump 312 as shown in FIG. 6) through the water balance line 122. The system 10 includes inlet line 150 connected to the water balance line 122. The inlet line 150 directs water from the water supply through the flow meter 18, thereby indicating the rate of flow water substituted for the foam. The components of the control box 14 then compare the flow of the water through the water flow meter system 16 to the flow of the water through the flow meter 19 to provide a reading of the relative flow rates. Thus, the test system 10 identifies proportional flow rates of the water supply and the foam concentrate. The percentage of the total flow through the water flow meter system 16 that is due to the flow through the flow meter 19 can be calculated using the measured total flow through water flow meter system 16 and the measured flow through the flow meter 19. This is accomplished without discharge of any foam concentrate, and the resulting water can be dispersed through the hose monster 230.

Furthermore, the probe 58 of the conductivity monitor/controller 34 is provided for measuring actual foam/water mixture flow. (FIG. 1). In this manner, the fire suppression system actually releases foam concentrate mixed with water through the water flow meter system 16. The probe 58 measures the conductivity levels of the resulting mixture, thereby determining whether the proper mixture of water and foam concentrate is being delivered by the fire suppression system.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A test system for testing a fire suppression system for a determination of a flow ratio of at least two different constituents where the fire suppression system is of a type that mixes the flow of the at least two constituents for distribution whereby only one of the two constituents is required for testing of the flow ratio, the system comprising: a control box; a first constituent flow meter system; and a second constituent line flow meter system, wherein the first constituent is directed through the first constituent flow meter system, the first constituent is directed through the second constituent line flow meter system, each flow meter system detecting a flow rate therein, and the control box compares the flow rates of the first constituent through each flow meter system, and indicates the flow rate ratio had the second constituent been directed through the second constituent line flow meter system, and wherein the test system is portable.

2. The test system of claim 1, wherein the test system may be connected and disconnected to the fire suppression system.

3. The test system of claim 1, wherein the control box includes a pair of flow rate meters.

4. The test system of claim 1, wherein said first constituent flow meter system receives first constituent from a fire protection first constituent supply at a flow rate appropriate for actual fire suppression conditions, and said second constituent line flow meter system receives first constituent from a water balance line.

5. The test system of claim 4, further including a booster pump between the second constituent line flow meter and the water balance line thereby providing first constituent with an inlet pressure to the second constituent line flow meter appropriate for actual fire suppression conditions to an outlet pressure from the second constituent storage.

6. The test system of claim 1, wherein first constituent is discharged from the test system.

7. The test system of claim 6, wherein first constituent is discharged through a nozzle providing a sufficient pressure to the test system.

8. The test system of claim 1, wherein first constituent is recovered from the test system.

9. The test system of claim 1, wherein first constituent is water.

10. The test system of claim 1, wherein second constituent is foam concentrate.

11. A test system for testing a fire suppression system for a determination of a flow ratio of at least two different constituents where the fire suppression system is of a type that mixes the flow of the at least two constituents for distribution whereby only one of the two constituents is required for testing of the flow ratio, the system comprising: a control box; a first constituent flow meter system; and a second constituent line flow meter system, wherein the first constituent is directed through the first constituent flow meter system, the first constituent is directed through the second constituent line flow meter system, each flow meter system detecting a flow rate therein, and the control box compares the flow rates of the first constituent through each flow meter system, and indicates the flow rate ratio had the second constituent been directed through the second constituent line flow meter system; and a recording means, wherein the recording means is a flatbed recorder.

12. A test system for testing a fire suppression system for a determination of a flow ratio of at least two different constituents where the fire suppression system is of a type that mixes the flow of the at least two constituents for distribution whereby only one of the two constituents is required for testing of the flow ratio, the system comprising: a control box; a first constituent flow meter system; and a second constituent line flow meter system, wherein the first constituent is directed through the first constituent flow meter system, the first constituent is directed through the second constituent line flow meter system, each flow meter system detecting a flow rate therein, and the control box compares the flow rates of the first constituent through each flow meter system, and indicates the flow rate ratio had the second constituent been directed through the second constituent line flow meter system, and wherein the control box is weatherproof.

13. A test system for testing fire suppression systems for a determination of a flow ratio of at least two different constituents where the fire suppression system is of a type that mixes the flow of two constituents for distribution wherein testing is accomplished where actual flow of the mixed two constituents is measured for testing of the flow ratio, and wherein testing is accomplished where only one of the two constituents, is required for testing of the predetermined ratio, the system comprising: a control box; a first constituent flow meter system; a second constituent line flow meter system, wherein the first constituent is directed through the first constituent flow meter system, the first constituent is directed through the second constituent line flow meter system, each flow meter system detecting a flow rate therein, and the control box compares the flow rates of the first constituent through each flow meter system, and indicates the flow rate ratio had the second constituent been directed through the second constituent line flow meter system; a probe for measuring the conductivity of the mixed constituents; a conductivity controller connected to said probe.

14. The test system of claim 13, wherein the system is portable.

15. The test system of claim 13, wherein the system may be connected and disconnected to a fire suppression system.

16. The test system of claim 13, wherein the control box includes a pair of flow rate meters.

17. The test system of claim 16, further comprising a recording means.

18. The test system of claim 17, wherein the recording means is a flatbed recorder.

19. The test system of claim 13, wherein the control box is weatherproof.

20. The test system of claim 13, wherein said first constituent flow meter system receives first constituent from a fire protection first constituent supply at a flow rate appropriate for actual fire suppression conditions, and said second constituent line flow meter system receives first constituent from a water balance line.

21. The test system of claim 20, further including a booster pump between the second constituent line flow meter system and the water balance line thereby providing first constituent with an inlet pressure to the second constituent line flow meter system appropriate for actual fire suppression conditions to an outlet pressure from the second constituent storage.

22. The test system of claim 13, wherein first constituent is discharged from the test system.

23. The test system of claim 22, wherein the first constituent is discharged through a nozzle providing a sufficient pressure to the test system.

24. The test system of claim 13, wherein the first constituent is water.

25. The test system of claim 13, wherein the second constituent 4 is foam concentrate.

* * * * *